US007386244B2

(12) United States Patent
Otsuka

(10) Patent No.: US 7,386,244 B2
(45) Date of Patent: Jun. 10, 2008

(54) FIXING DEVICE WITH TEMPERATURE DETECTOR AND IMAGE FORMING APPARATUS

(75) Inventor: Yutaka Otsuka, Toyokawa (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 61 days.

(21) Appl. No.: 11/417,019

(22) Filed: May 4, 2006

(65) Prior Publication Data

US 2007/0134017 A1 Jun. 14, 2007

(30) Foreign Application Priority Data

Dec. 8, 2005 (JP) ..... 2005-355088

(51) Int. Cl.
*G03G 15/20* (2006.01)

(52) U.S. Cl. ..... 399/69

(58) Field of Classification Search ..... 399/69, 399/70, 328, 329; 347/156
See application file for complete search history.

(56) References Cited

U.S. PATENT DOCUMENTS

| | | | | |
|---|---|---|---|---|
| 5,765,075 | A * | 6/1998 | Yamamoto | 399/69 |
| 6,078,780 | A * | 6/2000 | Abe et al. | 399/328 |
| 6,684,037 | B2 * | 1/2004 | Tamaoki | 399/69 |

FOREIGN PATENT DOCUMENTS

| | | | |
|---|---|---|---|
| JP | 6-19367 | | 1/1944 |
| JP | 59-180635 | U | 12/1984 |
| JP | 03-225235 | A | 10/1991 |
| JP | 2002-323378 | * | 11/2002 |
| JP | 2002-350234 | * | 12/2002 |
| JP | 2003-263066 | | 9/2003 |

* cited by examiner

*Primary Examiner*—Sandra L Brase
(74) *Attorney, Agent, or Firm*—Buchanan Ingersoll & Rooney PC

(57) ABSTRACT

A fixing device includes a pressure thermister for detecting temperature of a pressure roller. The fixing device also includes a thermal coating member on the opposite side of the pressure roller with respect to the pressure thermister. The thermal coating member has a thermal conductivity of 10W/m·K or more. The heat from the pressure roller is easily transferred to the thermal coating member because of the high thermal conductivity, so that the thermal coating member becomes warm quickly. This increases a temperature rise rate in the pressure thermister and therefore reduces time taken for warm-up of the fixing device.

20 Claims, 8 Drawing Sheets

FIXING DEVICE WITH TEMPERATURE DETECTOR AND IMAGE FORMING APPARATUS

CROSS-REFERENCE TO RELATED APPLICATIONS

This application is based on application No. 2005-355088 filed in Japan, the entire content of which is hereby incorporated by reference.

BACKGROUND OF THE INVENTION

The present invention relates to a fixing device for use in electrophotographic image forming apparatuses such as copying machines, laser printers and facsimile, and an image forming apparatus using the fixing device.

Conventional fixing devices include those detecting temperature on the surface of a heating roller by a noncontact temperature sensor (see JP 06-19367 A). Generally, the temperature sensor is covered with a cover material made of resin and located on an opposite side of the heating roller for protection of the sensor.

In the conventional fixing device, however, since the cover member made of resin is low in thermal conductivity and heat reflectivity, it is hard to conduct heat from the heating roller to the cover member. This makes it difficult to warm up the cover member, and therefore, to transfer the heat from the heating roller to the temperature sensor via the cover member. Thus, the temperature rise slows down in the temperature sensor. Moreover, the degree of heat reflection of the cover member is low. Therefore, it is difficult for the cover member to reflect radiant heat coming from the heating roller, and the radiant heat is not effectively conducted to the temperature sensor.

Thus, the temperature sensor has poor response to the temperature rise on the surface of the heating roller. This makes it impossible to reduce time taken for an operation which increases the temperature on the surface of the heating roller to a fixable temperature (hereinbelow referred to as warm-up).

More particularly, if the warm-up time is reduced and the temperature of the heating roller rises in a short period of time, then the heating roller suffers, for example, excessive temperature rise. This is because the temperature sensor is unable to detect the temperature of the heating roller with immediate response. When the temperature excessively rises in the heating roller, it becomes impossible to guarantee fixing quality of the recording member, durability of the heating roller and safety of the heating roller in terms of ignition prevention.

BRIEF SUMMARY OF THE INVENTION

An object of the present invention is to provide a fixing device which makes it possible to reduce warm-up time of a fixing device as well as to secure quality, durability and safety thereof.

In order to achieve the above-mentioned object, a first aspect of the present invention provides a fixing device, comprising:

a pair of rotors for fixing toner of a recording member while transporting the recording member in the state of being in contact with each other;

a heating section for heating at least one of the rotors;

a temperature detection section for detecting a surface temperature of at least one rotor at a position away from the surface of the rotor; and a thermal coating member set on an opposite side of a detection target-side rotor with respect to the temperature detection section, a temperature of the detection target-side rotor being detected by the temperature detection section, wherein the thermal coating member has a thermal conductivity of 10 W/m·K or more.

According to the fixing device in the present invention, the thermal coating member has a thermal conductivity of 10 W/m·K or more, and due to this high thermal conductivity of the thermal coating member, the heat from the detection target side-rotor is easily transferred to the thermal coating member. Thus, the thermal coating member becomes warm more quickly, which makes it possible to suppress transmission of heat from the temperature detection section to the thermal coating member and increases a temperature rise rate in the temperature detection section.

Therefore, the response of the temperature detection section to the temperature rise on the surface of the detection target-side rotor is enhanced, which reduces time taken for operation to increase the temperature on the surface of the detection target-side rotor to a fixable temperature (hereinbelow referred to as warm-up). More particularly, reduction in the warm-up time enables the temperature detection section to detect the temperature of the detection target-side rotor with sufficient response even when the temperature of the detection target-side rotor rises in a short period of time. This makes it possible to prevent, excessive temperature rise in the detection target-side rotor. Prevention of the excessive temperature rise in the detection target-side rotor leads to excellent fixing quality of the recording member, durability of the detection target-side rotor and safety of the detection target-side rotor in terms of ignition prevention.

A second aspect of the present invention provides a fixing device, comprising:

a pair of rotors for fixing toner of a recording member while transporting the recording member in the state of being in contact with each other;

a heating section for heating at least one of the rotors;

a temperature detection section for detecting a surface temperature of at least one rotor at a position away from the surface of the rotor;

a protection member for protecting the temperature detection section by covering the temperature detection section from an opposite side of a detection target-side rotor with respect to the temperature detection section, a temperature of the detection target-side rotor being detected by the temperature detection section; and a thermal coating member set between the protection member and the temperature detection section, wherein a thermal reflectivity of one face of the thermal coating member on a side of the temperature detection section is larger than a thermal reflectivity of one face of the protection member on the side of the temperature detection section.

According to the fixing device in this aspect, the reflectivity of the one face of the thermal coating member is larger than the reflectivity of the one face of the protection member, which makes it possible to reflect radiant heat from the detection target-side rotor off the one face of the thermal coating member and to transfer the heat to the temperature detection section.

Thereby, the temperature rise rate in the temperature detection section is increased, and therefore the response of the temperature detection section to the temperature rise on the surface of the detection target-side rotor is enhanced to reduce the warm-up time. More particularly, reduction in the warm-up time enables the temperature detection section to detect the temperature of the detection target-side rotor with sufficient response even when the temperature of the detection target-side rotor rises in a short period of time. This makes it possible to prevent excessive temperature rise in the detection target-side rotor. Prevention of the excessive temperature rise in the detection target-side rotor leads to excellent fixing quality of the recording member, durability of the detection target-side rotor and safety of the detection target-side rotor in terms of ignition prevention.

Since a protection member is provided for protecting the temperature detection section, the protection member prevents users from accidentally touching the temperature detection section. This prevents the temperature detection section from being damaged. Also, the temperature detection section can perform accurate detection without receiving influence of dust or wind in the device.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

The present invention is hereinbelow described in detail in conjunction with embodiments with reference to the drawings.

First Embodiment

Figure 1:
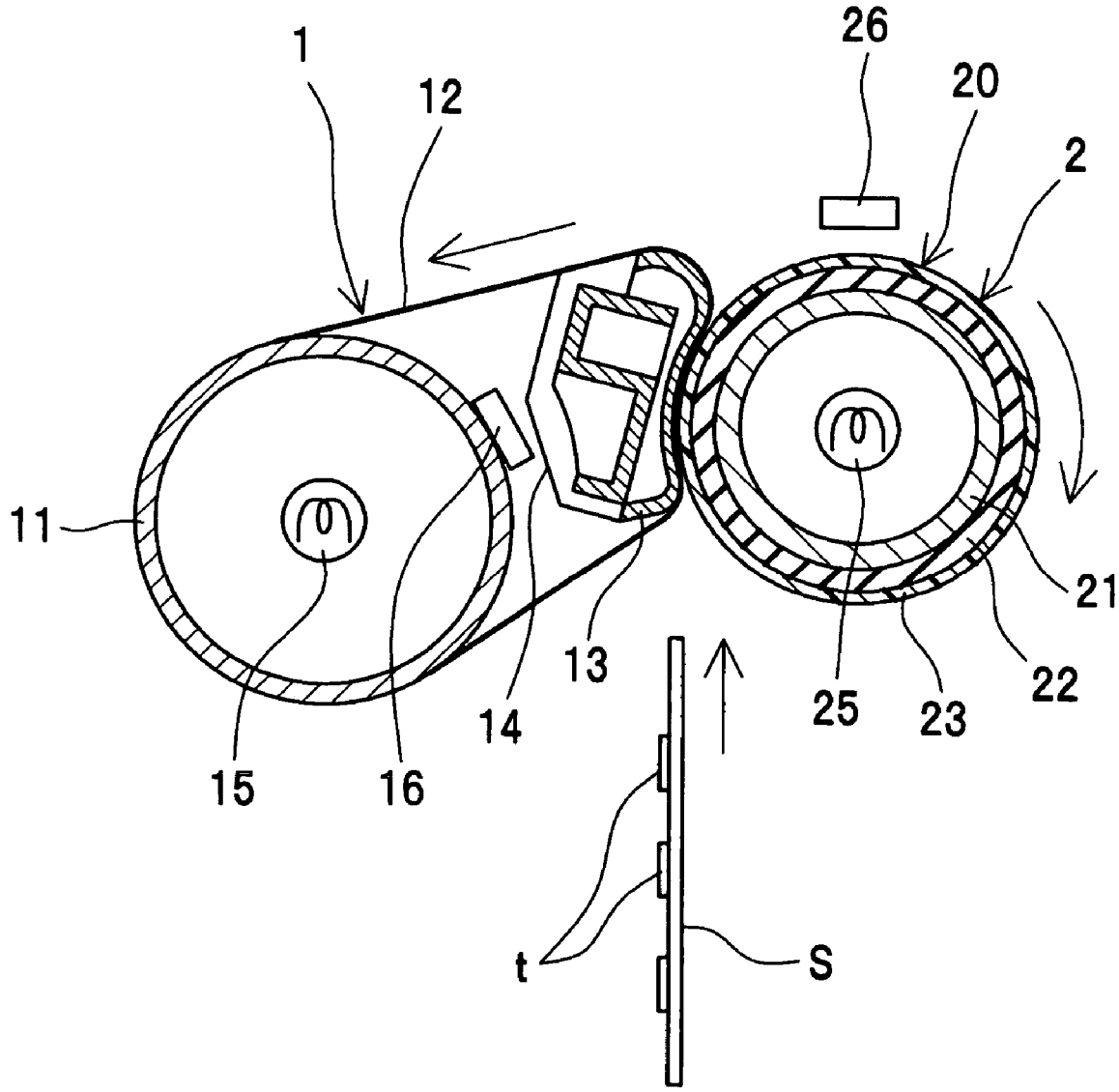
FIG. 1 is a cross sectional view showing a fixing device in a first embodiment of the present invention.

FIG. 1 is a simplified structure view showing a fixing device in a first embodiment of the present invention. The fixing device has a heating-side rotor 1 and a pressing-side rotor 2. The heating-side rotor 1 is heated by a heating-side heater 15 serving as a heating section, while the pressing-side rotor 2 is heated by a pressing-side heater 25 serving as a heating section.

A pair of these rotors 1, 2 fix toner t of a recording member S while transporting the recording member S in the state of being in contact with each other. More specifically, a nip section is formed by contact between the heating-side rotor 1 and the pressing-side rotor 2, and the nip section transports the recording member S while melting and fixing the toner t of the recording member S.

The recording member S is exemplified by sheets such as paper sheets and OHP sheets. The toner t is attached onto one face of the recording member S, and the toner t is made from materials having thermal meltability such as resins, magnetic substances and colorants.

The heating-side rotor 1 includes a heating roller 11, a backup member 13, and a belt 12 hung over the heating roller 11 and the backup member 13.

The heating-side rotor 1 is formed by a shaft made of aluminum or the like. An outer diameter of the heating-side rotor 1 is, for example, 30 mm.

The belt 12 has a base material layer, an elastic layer and a release layer placed from the inside to the outside of the belt. The base material layer is made from material having such strength as aluminum, iron and polyimide. The elastic layer is made from material having such heat resistance and elasticity as rubber, resin and silicone rubber. The release layer is made from material having such release ability and heat resistance as silicon rubber, fluorocarbon rubber, PFA, PTFE, FEP and PFEP. The belt 12 is formed by, for example, a polyimide with an outer diameter of 50 mm and a thickness of 70 μm, a silicon rubber with a thickness of 200 μm, and a PFA tube with a thickness of 20 μm, which are placed from the inside to the outside of the belt.

A face of the backup member 13 in contact with the belt 12 is low in coefficient of friction and is made of, for example, resin. The backup member 13 comes into contact with the pressing-side rotor 2 through the belt 12 to form the nip section. The outer face of the backup member 13 forming the nip section is formed into a recess shape. The backup member 13 has, for example, thickness of 4 mm and width of 12 mm in a circumferential direction of the belt 12. A radius of curvature of the recess-shaped outer face is 15.4 mm.

The backup member 13 is equipped with a reinforcing member 14 which supports the backup member 13 from the inside thereof. The reinforcing member 14 is made of, for example, stainless steel.

The pressing-side rotor 2 is a pressure roller 20. The pressure roller 20 has a support layer 21, an elastic layer 22 and a release layer 23, which are placed radially from the inside to the outside. The support layer 21 is exemplified by an iron shaft with an outer diameter of 30 mm. The elastic layer 22 is a silicon rubber for example. The release layer 23 is, for example, a fluorocarbon polymer such as PFA having a thickness of 30 μm. The pressure roller 20 is rotated by a drive section such as an unshown motor, and the belt 12 rotates following after the rotation of the pressing-side rotor 2 due to friction with the pressure roller 20.

The pressure roller 20 is pressed against the backup member 13 with a load of 100 to 530 N (Newton). In this case, a width size of the nip section is approx. 9 mm (the width size thereof is defined as a size in a rotation direction of the pressure roller 20). A length size of the nip section is approx. 40 mm (the length size of is defined as a size in a rotation direction of the pressure roller 20). It goes without saying that the width size and the length size of the nip section may be changed in proportion to changes of the load.

The heating-side heater 15 is set inside the heating roller 11 so as to heat the heating roller 11 and the belt 12 from the inside. The pressing-side heater 25 is set inside the pressure roller 20 so as to heat the pressure roller 20 from the inside. The heaters 15, 25 increase the temperature of the belt 12 and the pressure roller 20 to a temperature allowing the toner t of the recording member S to be fixed.

A heating thermister 16 serving as a temperature detection section is provided on the outside of the heating roller 11. The heating thermister 16 comes into contact with the surface of the heating roller 11 and detects the surface temperature of the heating roller 11.

A pressure thermister 26 serving as a temperature detection section is provided on the outside of the pressure roller 20. The pressure thermister 26 detects the surface temperature of the pressure roller 20 at a position away from the surface of the pressure roller 20.

Herein, the pressure thermister 26 is a noncontact sensor. As the result, the pressure thermister 26 does not inflict damages on the surface of the pressure roller 20, and therefore makes it possible to enhance the durability of the pressure roller 20 and to prevent image noise.

The heating roller 11 and the pressure roller 20 are each controlled by an unshown control section so as to maintain specified temperatures based on outputs from the heating thermister 16 and the pressure thermister 26.

Figure 2A:
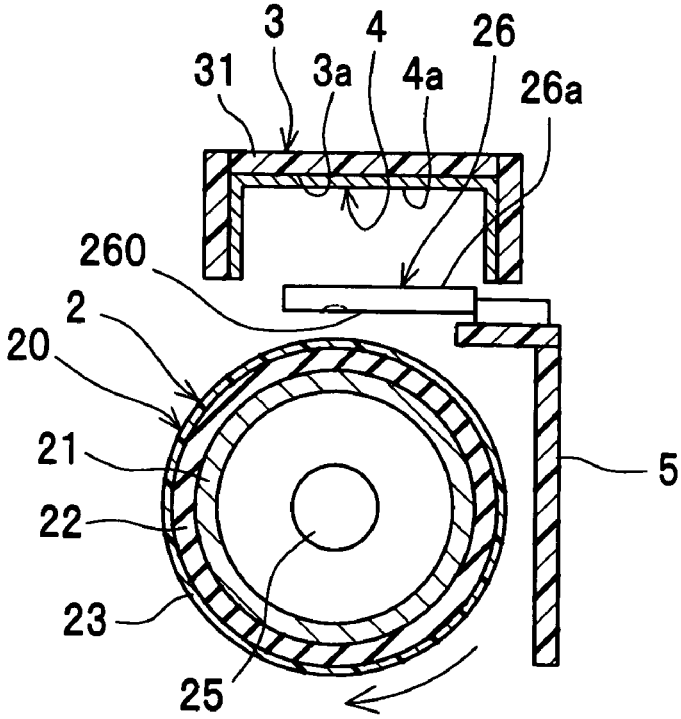
FIG. 2A is a transverse cross sectional view showing a pressure application side of the fixing device.
Figure 2B:
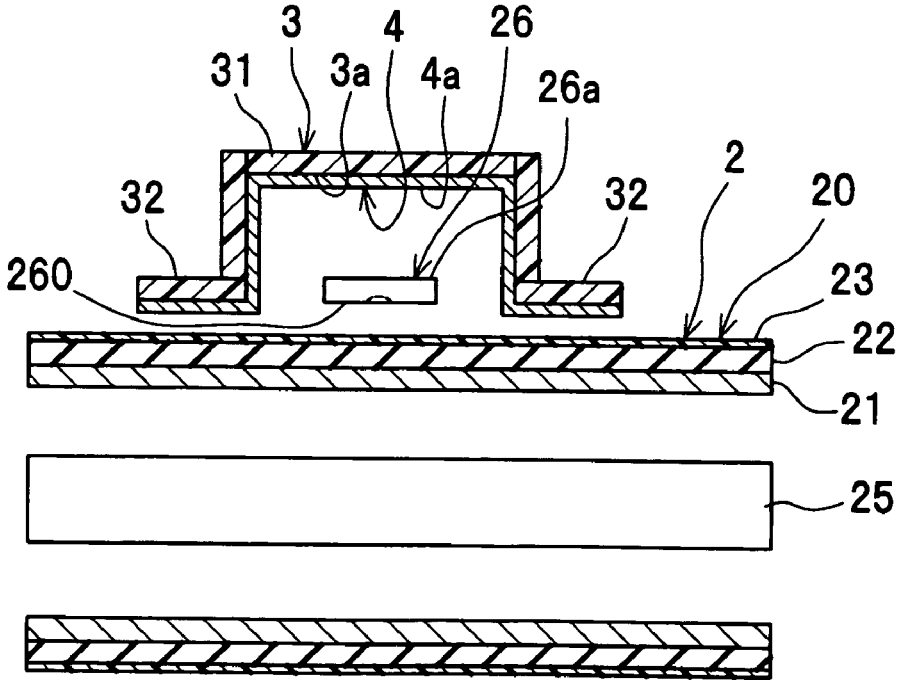
FIG. 2B is a vertical cross sectional view showing the pressure application side of the fixing device.

As shown in FIG. 2A and FIG. 2B, the pressure thermister 26 is mounted on a casing 5 equipped with the pressure roller 20. The pressure thermister 26 has a temperature detection face 260 facing the pressure roller 20.

A protection member 3 is provided on the opposite side of the pressure roller 20 with respect to the pressure thermister 26. The protection member 3 protects the pressure thermister 26 by covering the pressure thermister 26 from the opposite side of the pressure roller 20.

The protection member 3 is formed from resin. The protection member 3 has a box section 31 having a square bottom face and a flange section 32 provided on an open end of the box section 31.

The box section 31 is a rectangular parallelepiped of, for example, 30 mm wide×30 mm long, 20 mm high and 2 mm thick. The flange section 32 is provided on both sides of the open ends of the box section 31 in an axial direction of the pressure roller 20. The flange section 32 extends along the axial direction of the pressure roller 20.

The presence of the protection member 3 prevents users from accidentally touching the pressure thermister 26 when dealing with a paper jam and the like, and this prevents the pressure thermister 26 from being damaged. Moreover, the pressure thermister 26 can perform accurate detection without receiving influence of dust or wind in the device.

A thermal coating member 4 is provided between the protection member 3 and the pressure thermister 26. More particularly, the thermal coating member 4 is mounted on the inner face of the protection member 3. More specifically, the thermal coating member 4 is mounted on the inner face of the box section 31 and a face of the flange section 32 facing the pressure roller 20.

The thermal coating member 4 has a thermal conductivity of 10 W/m·K or more, which is larger than the thermal conductivity of the resin, 0.2 W/m·K. More particularly, the thermal conductivity of the protective sheet 4 is larger than the thermal conductivity of the protection member 3.

Moreover, the thermal reflectivity of one face 4*a* of the thermal coating member 4 on the side of the pressure thermister 26 is larger than the thermal reflectivity of one face 3*a* of the protection member 3 on the side of the pressure thermister 26. Further, the thermal reflectivity of the one face 4*a* of the thermal coating member 4 on the side of the pressure thermister 26 is larger than the thermal reflectivity of one face 26*a* of the pressure thermister 26 on the side of the thermal coating member 4.

The thermal coating member 4 is made of, for example, aluminum. More specifically, the thermal coating member 4 is an aluminum foil or an aluminum tape with a thickness of approx. 15 μm. The thermal coating member 4 may be provided on the inner face of the protection member 3 by coating and plating, or the thermal coating member 4 may be attached onto the inner face of the protection member 3 with use of a double-faced tape.

The thermal coating member 4 includes a portion whose distance from the surface of the pressure roller 20 is almost equal to a distance between the temperature detection face 260 and the surface of the pressure roller 20. More particularly, the thermal coating member 4 on the flange section 32 is positioned almost flush with the temperature detection face 260.

The thermal coating member 4 extends longer than the pressure thermister 26 in a rotational direction of the pressure roller 20 as shown in FIG. 2A and covers the pressure thermister 26. The thermal coating member 4 extends longer than the pressure thermister 26 in a rotational axis direction of the pressure roller 20 as shown in FIG. 2B and covers the pressure thermister 26.

Figure 3A:
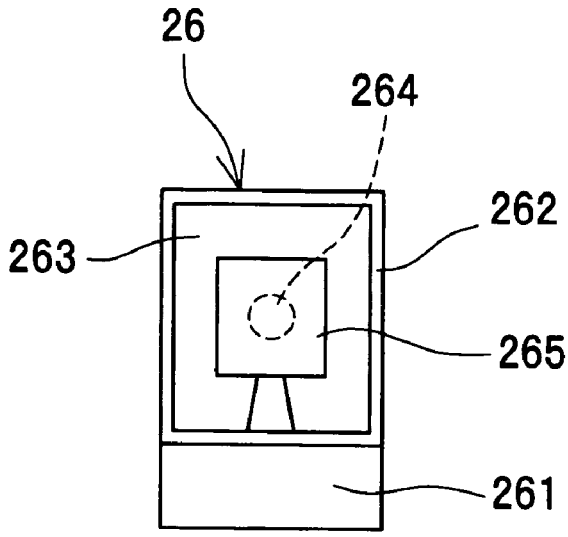
FIG. 3A is a plane view showing a pressure thermister.
Figure 3B:
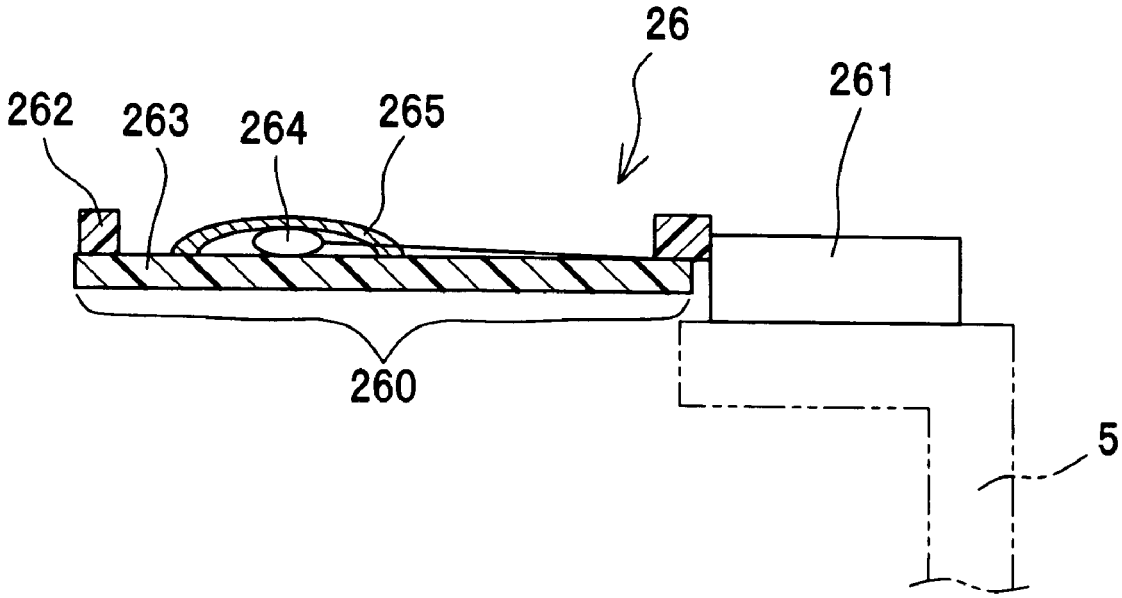
FIG. 3B is a cross sectional view showing the pressure thermister.

As shown in FIG. 3A and FIG. 3B, the pressure thermister 26 includes a mounting section 261 mounted on the casing 5, a frame section 262 fixed on the mounting section 261, a retention section 263 mounted on the bottom face of the frame section 262, a thermal element 264 placed on the upper face of the retention section 263, and a heat collecting section 265 for covering the thermal element 264 from the upper side thereof. Herein, the bottom face side refers to the pressure roller 20 side. More particularly, the bottom face of the retention section 263 corresponds to the temperature detection face 260.

The heat collecting section 265 fixes the thermal element 264 onto the retention section 263. The heat collecting section 265 collects heat from the pressure roller 20 and transfers the heat to the thermal element 264. The thermal reflectivity of one face 265*a* of the heat collecting section 265 on the side of the thermal coating member 4 is smaller than the thermal reflectivity of the one face 4*a* of the thermal coating member 4.

Description is now given to the action of the fixing device with reference to FIG. 1.

First, temperature of the fixing device is adjusted. More particularly, the temperatures on the surface of the belt 12 and the surface of the pressure roller 20 are adjusted to a fixable temperature (hereinbelow referred to as warm-up).

Herein, the warm-up is performed immediately after power is applied to the device, upon recovery from a paper jam, when the cover of the device is opened or closed, or upon recovery from a sleep mode.

The heating-side heater 15 and the pressing-side heater 25 are turned on to increase the surface temperature of the belt 12 and the pressure roller 20.

In the case of the pressure roller 20, it is impossible to warm up all the way to the surface of the pressure roller 20 in a short time only with the pressing-side heater 25 because the support layer 21 and the elastic layer 22 are thick. Moreover, the heating-side heater 15 can warm up only a part of the heating roller 11 and the belt 12.

Accordingly, the belt 12 and the heating roller 11 are rotated by rotating the pressure roller 20, so that heat of the heating roller 11 is conducted to the entire belt 12 and to the surface of the pressure roller 20.

Thus, it becomes possible to raise the surface temperatures of the belt 12 and the pressure roller 20 to the fixable temperature in a shorter time by turning on the heaters 15, 25 and rotating the belt 12 and the heating roller 11.

Herein, a relation T'=R×T is satisfied wherein T represents a detected temperature of the pressure thermister 26, R represents a correction factor and T' represents a corrected temperature. The corrected temperature T' is used in control for the temperature adjustment.

When both the temperature detected-by the heating thermister 16 and the corrected temperature T' detected by the pressure thermister 26 reach a specified temperature, an indication READY is displayed to notify a fixable state. For example, the indication READY is displayed when the detected temperature by the heating thermister 16 is 190° C., and the corrected temperature T' by the pressure thermister 26 is 120° C.

If a print signal is not present, the device is put in a print standby state, whereas if the print signal is present, print operation is started. Herein, the word "print" refers to printing operation by a printer in the case where the fixing device is used in the printer.

In the standby state, normally, the rotation of the belt 12 and the pressure roller 20 is stopped. Then, the heaters 15, 25 are controlled so as to keep the temperature of the belt 12 and the pressure roller 20 at a specified set temperature.

In the print operation, from start of the print operation by the time before the recording member S goes into the fixing device, the temperature of the pressure roller 20 is increased by conducting heat from the heating roller 11 to the belt 12 and the pressure roller 20, which is achieved by rotating the belt 12 and the pressure roller 20.

Next, the toner t of the recording member S is fixed by using the fixing device. The recording member S is sent into the nip section formed by contact between the belt 12 and the pressure roller 20. The unfixed toner t is attached on one face of the recording member S.

In the nip section, the one face of the recording member S is pressed while being heated, by which the unfixed toner t is melted and fixed. At the same time, transportation force is imparted to the other face of the recording member S by the rotation of the pressure roller 20, and thereby the recording member S is transported. Herein, the belt 12 rotates following after the transportation of the recording member S.

According to the thus-structured fixing device, the thermal coating member 4 has a thermal conductivity of 10 W/m·K or more. This high thermal conductivity of the thermal coating member 4 allows the heat from the pressure roller 20 to be easily transferred to the thermal coating member 4. Thus, the thermal coating member 4 becomes warm more quickly, which makes it possible to suppress transmission of heat from the pressure thermister 26 to the thermal coating member 4, and therefore, a temperature-rise-rate of the pressure thermister 26 is increased.

Therefore, the response of the pressure thermister 26 is enhanced with respect to the temperature rise on the surface of the pressure roller 20, so that time taken for warm-up can be reduced. More particularly, reduction in the warm-up time enables the pressure thermister 26 to detect the temperature of the pressure roller 20 with sufficient response even when the temperature of the pressure roller 20 rises in a short period of time. This makes it possible to prevent, for example, excessive temperature rise in the pressure roller 20. Prevention of the excessive temperature rise in the pressure roller 20 secures fixing quality of the recording member S, durability of the pressure roller 20 and safety of the pressure roller 20 in terms of ignition prevention.

When the protection member 3 is made of resin for example, the thermal conductivity of the thermal coating member 4 is made larger than that of the resin. Since the thermal conductivity of the thermal coating member 4 is larger than the thermal conductivity of the protection member 3, the heat transfer by the thermal coating member 4 can reliably be enhanced and the warm-up time can be reliably shorten.

Moreover, the thermal coating member 4 includes a portion where a distance from the surface of the pressure roller 20 is almost equal to a distance between the temperature detection face 260 and the surface of the pressure roller 20. This makes it possible to transfer heat from the pressure roller 20 to the temperature detection face 260 and the thermal coating member 4 at almost the same time and thereby allows the thermal coating member 4 to be warm more quickly.

Thus, the response of the pressure thermister 26 to the temperature rise on the surface of the pressure roller 20 is further enhanced, so that the warm-up time can be further reduced.

The thermal coating member 4 extends longer than the pressure thermister 26 in the rotational axis direction of the pressure roller 20 and covers the pressure thermister 26, which further enhances the response of the pressure thermister 26 to the temperature rise on the surface of the pressure roller 20. Thereby, the warm-up time can be further reduced.

The thermal coating member 4 extends longer than the pressure thermister 26 in the rotational direction of the pressure roller 20 in order to cover the pressure thermister 26. Thereby, the response of the pressure thermister 26 to the temperature rise on the surface of the pressure roller 20 is further enhanced, so that the warm-up time can be further reduced.

The reflectivity of the one face 4*a* of the thermal coating member 4 is larger the reflectivity of the one face 3*a* of the protection member 3. This makes it possible to reflect radiant heat, which is derived from the pressure roller 20, off the one face 4*a* of the thermal coating member 4, and therefore to transfer the heat to the pressure thermister 26.

That is to say, when the protection member 3 is formed from resin for example, the thermal reflectivity of the thermal coating member 4 is made larger than the reflectivity of the resin. Thereby, the temperature rise rate in the pressure thermister 26 is increased, which further enhances the response of the pressure thermister 26 to the temperature rise on the surface of the pressure roller 20, and reduces the warm-up time.

The reflectivity of the one face 4*a* of the thermal coating member 4 is larger than the reflectivity of the one face 26*a* of the pressure thermister 26. This makes it possible to reduce the amount of radiant heat going back to the one face 4*a* of the thermal coating member 4, where the radiant heat from the pressure roller 20 is reflected off the one face 26*a* of the pressure thermister 26 after being reflected off the one face 4*a* of the thermal coating member 4.

Therefore, the radiant heat reflected off the one face 4*a* of the thermal coating member 4 can effectively be transferred to the pressure thermister 26. Thereby, the temperature rise rate in the pressure thermister 26 can be increased, the response of the pressure thermister 26 to the temperature rise on the surface of the pressure roller 20 can be further enhanced, and the warm-up time can be further reduced.

It should be satisfied that thermal conductivity of the thermal coating member 4 is 10 W/m·K or more, or that the thermal reflectivity of the one face 4*a* of the thermal coating member 4 is larger than the thermal reflectivity of the one face 3*a* of the protection member 3.

The thermal coating member 4 should extend longer than the pressure thermister 26 in the rotational axis direction of the pressure roller 20 and in the rotation direction of the pressure roller 20.

Further, as viewed from the opposite side of the pressure roller 20 with respect to the thermal coating member 4, the thermal coating member 4 should cover the heat collecting section 265 and should be equal to or larger than the heat collecting section 265 in size. This makes it possible to downsize the thermal coating member 4 and to achieve cost reduction.

Second Embodiment

Figure 4A:
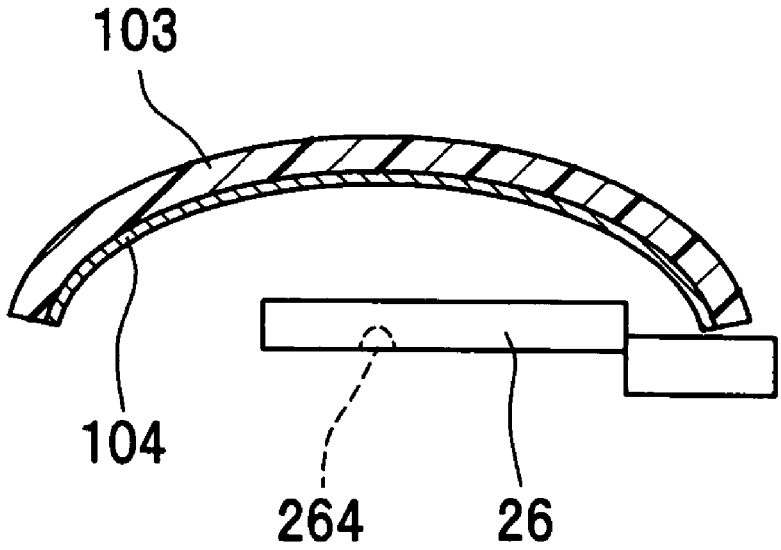
FIG. 4A is a transverse cross sectional view showing a pressure application side of a fixing device in a second embodiment of the present invention.
Figure 4B:
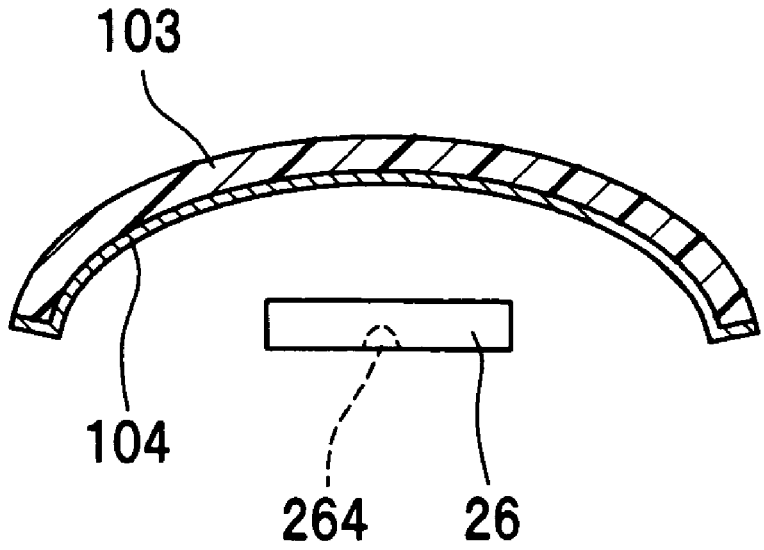
FIG. 4B is a vertical cross sectional view showing the pressure application side of the fixing device in the second embodiment of the present invention.

FIGS. 4A and 4B show a fixing device in a second embodiment of the present invention. The second embodiment is different from the first embodiment in the shape of the protection member and the thermal coating member. In the second embodiment, the materials of the protection member and the thermal coating member are the same as those in the first embodiment.

Specifically, a protection member 103 and a thermal coating member 104 in the second embodiment have parabolic inner shapes. The protection member 103 has such a parabolic shape that the thermal element 264 of pressure thermister 26 can be positioned at a focus of protection member 103. The thermal coating member 104 is provided on the inner face of the protection member 103.

Therefore, radiant heat from the pressure roller 20 can be concentrated upon the thermal element 264 by the parabolic-shaped thermal coating member 104, which allows further increase in response rate of the pressure thermister 26 to the temperature rise of the pressure roller 20.

Third Embodiment

Figure 5A:
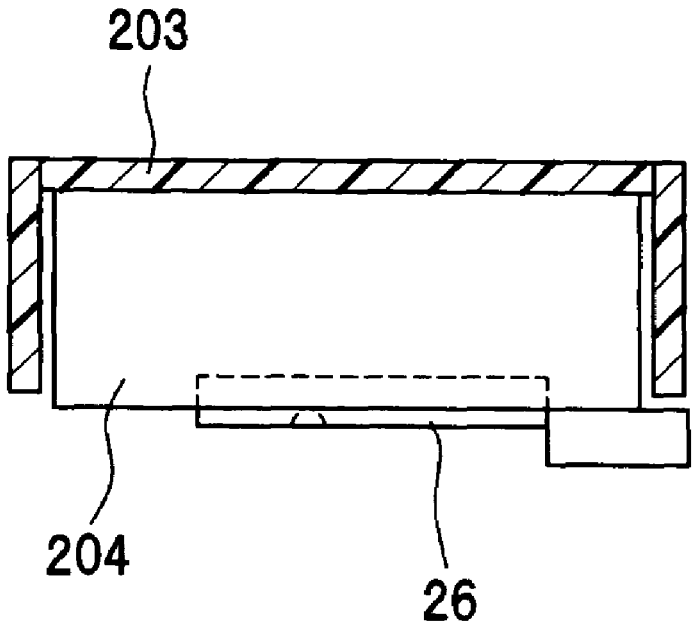
FIG. 5A is a transverse cross sectional view showing a pressure application side of a fixing device in a third embodiment of the present invention.
Figure 5B:
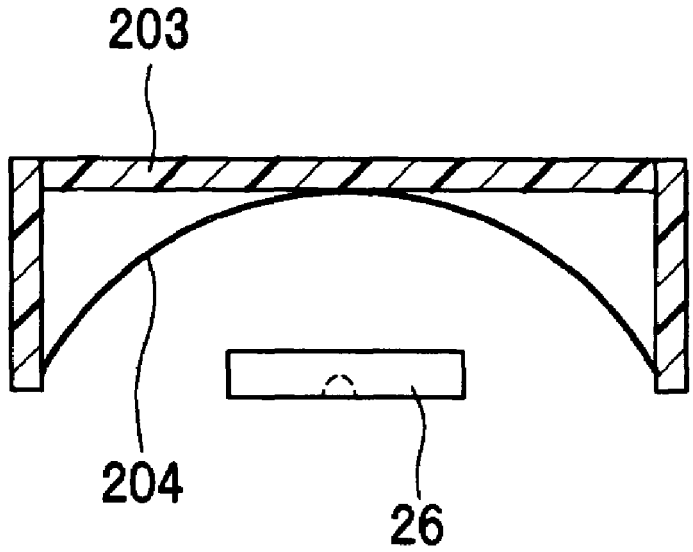
FIG. 5B is a vertical cross sectional view showing the pressure application side of the fixing device in the third embodiment of the present invention.

FIGS. 5A and 5B show a fixing device in a third embodiment of the present invention. The third embodiment is different from the first embodiment in the shape of the thermal coating member. In the third embodiment, the material of the thermal coating member is the same as that in the first embodiment.

Specifically, a thermal coating member 204 in the third embodiment has a plate shape curved in a shaft direction of the pressure roller 20. The thermal coating member 204 is formed into a parabolic shape or a circular arc shape in cross section in the axial direction of the pressure roller 20. The thermal coating member 104 is mounted on the inner face of a rectangular parallelepiped protection member 203 with spaces therebetween.

This makes it possible to downsize the thermal coating member 204 and to effectively transfer the radiant heat from the pressure roller 20 to the pressure thermister 26.

It is to be noted that the curved shape of the thermal coating member 204 may be changed to such a parabolic shape as described in the second embodiment.

Fourth Embodiment

Figure 6A:
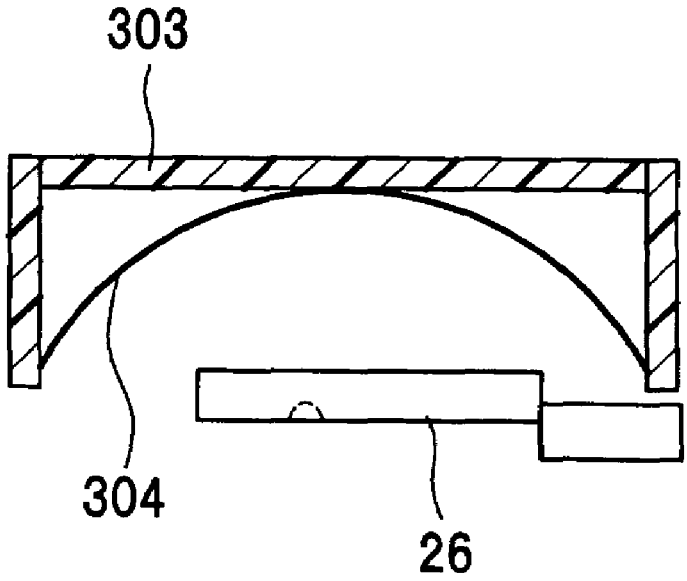
FIG. 6A is a transverse cross sectional view showing a pressure application side of a fixing device in a fourth embodiment of the present invention.
Figure 6B:
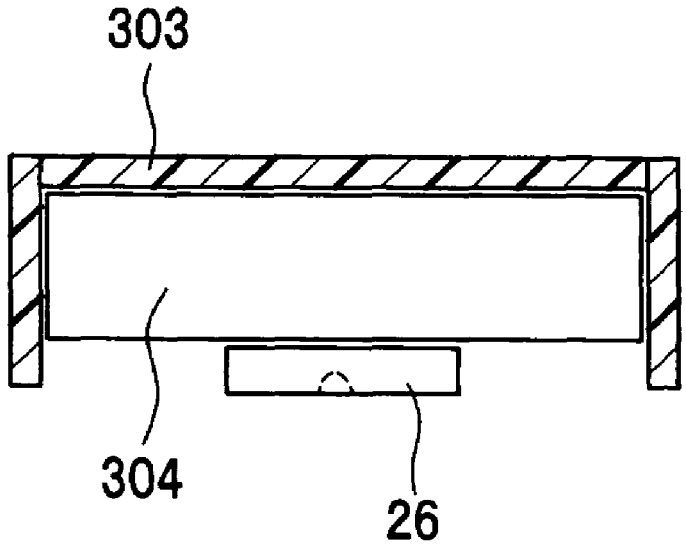
FIG. 6B is a vertical cross sectional view showing the pressure application side of the fixing device in the fourth embodiment of the present invention.

FIGS. 6A and 6B show a fixing device in a fourth embodiment of the present invention. The fourth embodiment is different from the first embodiment in the shape of the thermal coating member. In the forth embodiment, the material of the thermal coating member is the same as that in the first embodiment.

More particularly, a thermal coating member 304 in the fourth embodiment has a plate shape curved in a rotation direction of the pressure roller 20. The thermal coating member 304 is formed into a parabolic shape or a circular arc shape in cross section in a direction perpendicular to the axis of the pressure roller 20. The thermal coating member 304 is mounted on the inner face of a rectangular parallelepiped protection member 303 with a space.

This makes it possible to downsize the thermal coating member 304 and to effectively transfer the radiant heat from the pressure roller 20 to the pressure thermister 26.

It is to be noted that the curved shape of the thermal coating member 304 may be changed to such a parabolic shape as described in the second embodiment.

Fifth Embodiment

Figure 7A:
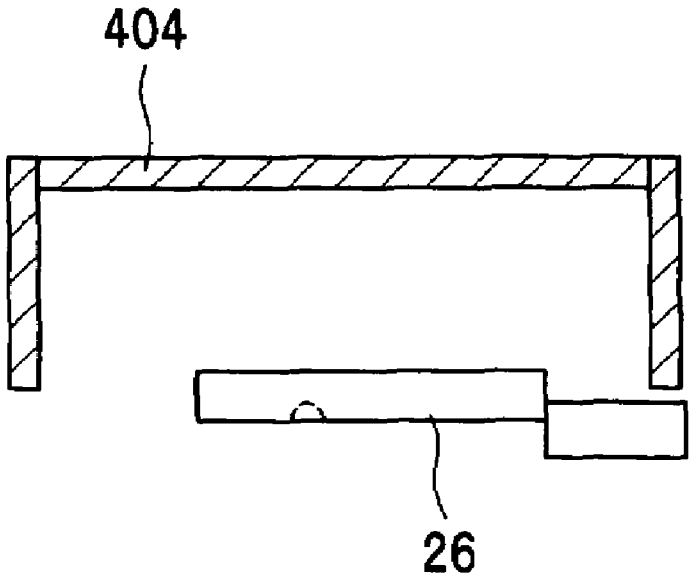
FIG. 7A is a transverse cross sectional view showing a pressure application side of a fixing device in a fifth embodiment of the present invention.
Figure 7B:
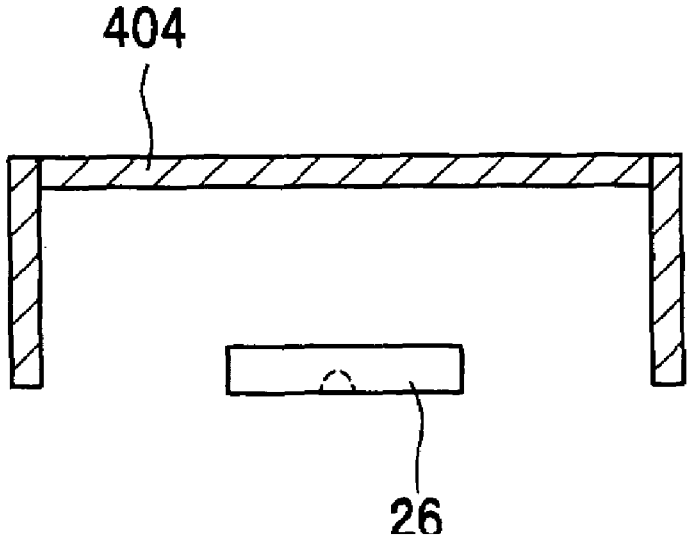
FIG. 7B is a vertical cross sectional view showing the pressure application side of the fixing device in the fifth embodiment of the present invention.
Figure 8:
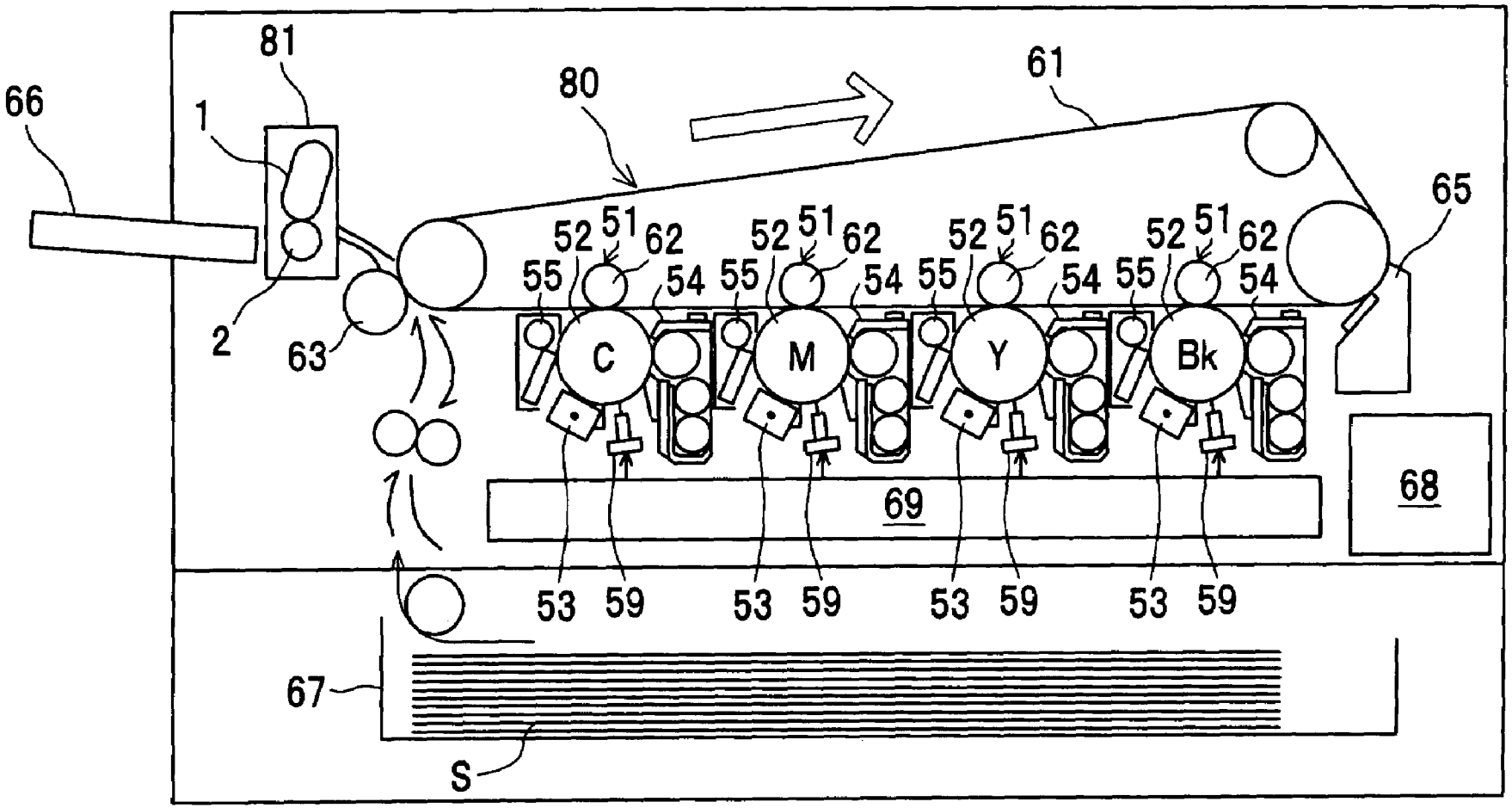
FIG. 8 is a simplified structure view showing an image forming apparatus of the present invention.

FIGS. 7A and 7B show a fixing device in a fifth embodiment of the present invention. The fifth embodiment has no protection member unlike the first embodiment. In the fifth embodiment, the material of the thermal coating member is the same as that in the first embodiment.

More particularly, a thermal coating member 404 in the fifth embodiment also functions as a protection member for protecting the pressure thermister 26, where the protection member covers the pressure thermister 26 from the opposite side of the pressure roller 20 with respect to the pressure thermister 26.

The thermal coating member 404 is made of material having high thermal conductivity. For example, a thin metal member made of aluminum, copper and the like is used for the thermal coating member 404.

This allows reduction in the number of components and downsizing of the device because the thermal coating member 404 also functions as the protection member.

Sixth Embodiment

Specifically, a thermal coating member 204 in the third embodiment has a plate shape curved in a shaft direction of the pressure roller 20. The thermal coating member 204 is formed into a parabolic shape or a circular arc shape in cross section in the axial direction of the pressure roller 20. The thermal coating member 204 is mounted on the inner face of a rectangular parallelepiped protection member 203 with spaces therebetween.

The image forming device 80 includes an intermediate transfer belt 61, four image forming units 51 disposed along the intermediate transfer belt 61 so as to form toner images, a primary transfer section 62 for transferring the toner images formed by the respective image forming units 51 onto the intermediate transfer belt 61, and a secondary transfer section 63 for transferring the images transferred onto the intermediate transfer belt 61 onto the recording member S.

The image forming unit 51 forming a black (BK) toner image, the image forming unit 51 for forming a yellow (Y) toner image, the image forming unit 51 for forming a magenta (M) toner image and the image forming unit 51 for forming a cyan (C) toner image are disposed in sequence along the upper stream toward the downs stream of the intermediate transfer belt 61.

Each of the image forming units 51 includes a photoreceptor drum 52, a charging section 53 for uniformly charging the photoreceptor drum 52, an exposure section 59 for applying image exposure to the charged photoreceptor drum 52, and a development section 54 for developing an electrostatic latent image formed through exposure with the toner of respective colors.

The image forming apparatus includes a control device 68 for controlling the entire image forming apparatus and an exposure control device 69 for receiving signals corresponding to images sent from the control device 68. The exposure control device 69 drives each of the exposure sections 59 corresponding to the respective colors.

Description is now given of the action of the image forming apparatus.

A toner image developed on the photoreceptor drum 52 of an image forming unit 51 is primary-transferred onto the intermediate transfer belt 61 at a position of contact with the intermediate transfer belt 61 by the primary transfer section 62.

The toner image transferred onto the intermediate transfer belt 61 receives respective colors on top thereof as the toner image passes the respective image forming units 51, and a full-color toner image is finally formed on the intermediate transfer belt 61.

Then, the full-color toner image on the intermediate transfer belt 61 is collectively subjected to secondary transfer onto the recording member S on the down stream side of the intermediate transfer belt 61 by the secondary transfer section 63.

Then, the recording member S passes the fixing device 81 placed in the downstream side of a transportation path of the recording member S, by which the toner image is fixed and the recording member S is discharged onto a discharge tray 66.

The recording member S is housed in a cassette 67 in a lowermost section and is transported one by one from the cassette 67 to the secondary transfer section 63.

After the primary transfer, the toner remaining on the photoreceptor drum 52 is removed by a cleaning section 55 set on the downstream side, and is collected from the lower side of the cleaning section 55.

After the secondary transfer, the toner remaining on the intermediate transfer belt 61 is removed from the intermediate transfer belt 61 by a cleaning blade 65, and is transported by an unshown transportation screw so as to be collected in an unshown waste toner container.

The thus-structured image forming apparatus includes the fixing device 81, which makes it possible to reduce warm-up time while securing quality, durability and security. It should be noted that the fixing device in any one of the second embodiment to the fifth embodiment may be employed as a fixing device of the image forming apparatus.

It should be also noted that the present invention is not limited to the above-stated embodiments. For example, the heating-side rotor 1 may be a roller instead of the belt. The pressing-side rotor 2 may be a belt instead of the roller.

It is also possible to provide a temperature detection section for detecting the temperature of at least one rotor among a pair of the rotors 1, 2 and to mount the thermal coating member on the temperature detection section. Moreover, a thermocouple may be used instead of the thermister as the temperature detection section.

Only one rotor among a pair of the rotors 1, 2 may be heated if it is possible to fix the toner t of the recording member S.

The thermal coating member should satisfy either a requirement that the thermal coating member has a thermal conductivity of 10 W/m·K or more or a requirement that the thermal reflectivity of one face of the thermal coating member on the temperature detection section side is larger than the thermal reflectivity of one face of the protection member on the temperature detection section side.

Moreover, the image forming apparatus may be any one of monochrome/color copiers, printers, facsimiles and compound machines thereof.

The invention being thus described, it will be obvious that the invention may be varied in many ways. Such variations are not be regarded as a departure from the spirit and scope of the invention, and all such modifications as would be obvious to one skilled in the art are intended to be included within the scope of the following claims.

The invention claimed is:

1. A fixing device, comprising: a pair of rotors for fixing toner of a recording member while transporting the recording member in the state of being in contact with each other; a heating section for heating at least one of the rotors; a temperature detection section for detecting a surface temperature of at least one rotor at a position away from the surface of the rotor; and a thermal coating member set on an opposite side of a detection target-side rotor with respect to the temperature detection section, a temperature of the detection target-side rotor being detected by the temperature detection section, wherein the thermal coating member has a thermal conductivity of 10 W/m·K or more.

2. The fixing device as set forth in claim 1, comprising a protection member for protecting the temperature detection section by covering the temperature detection section from the opposite side of the detection target-side rotor with respect to the temperature detection section, wherein the thermal coating member is set between the protection member and the temperature detection section, and the conductivity of the thermal coating member is larger than the thermal conductivity of the protection member.

3. The fixing device as set forth in claim 2, wherein a thermal reflectivity of one face of the thermal coating member on a side of the temperature detection section is larger than a thermal reflectivity of one face of the protection member on the side of the temperature detection section.

4. The fixing device as set forth in claim 2, wherein the thermal coating member is provided on an inner face of the protection member by coating or plating.

5. The fixing device as set forth in claim 1, wherein the thermal coating member also functions as a protection member for protecting the temperature detection section by covering the temperature detection section from the opposite side of the detection target-side rotor with respect to the temperature detection section.

6. The fixing device as set forth in claim 1, wherein a thermal reflectivity of one face of the thermal coating member on a side of the temperature detection section is larger than a thermal reflectivity of one face of the temperature detection section on the side of the thermal coating member.

7. The fixing device as set forth in claim 1, wherein the temperature detection section comprises: a thermal element; and a heat collecting section for covering the thermal element from an opposite side of the detection target-side rotor with respect to the thermal element while collecting heat from the detection target-side rotor and transferring-the heat to the thermal element, wherein as viewed from an opposite side of the detection target-side rotor with respect to the thermal coating member, the thermal coating member covers the heat collection section, and the thermal coating member is at least equal in size to the heat collection section.

8. The fixing device as set forth in claim 1, wherein the temperature detection section has a temperature detection face facing the detection target-side rotor, and the thermal coating member includes a portion where a distance from a surface of the detection target-side rotor is almost equal to a distance between the temperature detection face and the surface of the detection target-side rotor.

9. The fixing device as set forth in claim 1, wherein the thermal coating member extends longer than the temperature detection section in a rotational axis direction of the detection target-side rotor and covers the temperature detection section.

10. The fixing device as set forth in claim 1, wherein the thermal coating member extends longer than the temperature detection section in a rotation direction of the detection target-side rotor and covers the temperature detection section.

11. The fixing device as set forth in claim 1, wherein the thermal coating member is formed from an aluminum foil or an aluminum tape.

12. An image forming apparatus comprising the fixing device as set forth in claim 1.

13. A fixing device, comprising: a pair of rotors for fixing toner of a recording member while transporting the recording member in the state of being in contact with each other; a heating section for heating at least one of the rotors; a temperature detection section for detecting a surface temperature of at least one rotor at a position away from the surface of the rotor; a protection member for protecting the temperature detection section by covering the temperature detection section from an opposite side of a detection target-side rotor with respect to the temperature detection section, a temperature of the detection target-side rotor being detected by the temperature detection section; and a thermal coating member set between the protection member and the temperature detection section, wherein a thermal reflectivity of one face of the thermal coating member on a side of the temperature detection section is larger than a thermal reflectivity of one face of the protection member on the side of the temperature detection section.

14. The fixing device as set forth in claim 13, wherein a thermal reflectivity of one face of the thermal coating member on a side of the temperature detection section is larger than the thermal reflectivity of one face of the temperature detection section on the side of the thermal coating member.

15. The fixing device as set forth in claim 13, wherein the temperature detection section comprises: a thermal element; and a heat collecting section for covering the thermal element from an opposite side of the detection target-side rotor with respect to the thermal element while collecting heat from the detection target-side rotor and transferring the heat to the thermal element, wherein as viewed from an opposite side of the detection target-side rotor with respect to the thermal coating member, the thermal coating member covers the heat collection section and the thermal coating member is at least equal in size to the heat collection section.

16. The fixing device as set forth in claim 13, wherein the thermal coating member extends longer than the temperature detection section in a rotational axis direction of the detection target-side rotor and covers the temperature detection section.

17. The fixing device as set forth in claim 13, wherein the thermal coating member extends longer than the temperature detection section in a rotation direction of the detection target-side rotor and covers the temperature detection section.

18. The fixing device as set forth in claim 13, wherein the thermal coating member is formed from an aluminum foil or an aluminum tape.

19. The fixing device as set forth in claim 13, wherein the thermal coating member is provided on an inner face of the protection member by coating or plating.

20. An image forming apparatus comprising the fixing device as set forth in claim 13.

* * * * *